US007464744B2

(12) United States Patent
Manoff

(10) Patent No.: US 7,464,744 B2
(45) Date of Patent: Dec. 16, 2008

(54) SHOT SLEEVE INSERT AND METHOD OF RETARDING HEAT EROSION WITHIN A SHOT SLEEVE BORE

(76) Inventor: Peter Manoff, 501 E. Lockwood Ave., Webster Groves, MO (US) 63119

( * ) Notice: Subject to any disclaimer, the term of this patent is extended or adjusted under 35 U.S.C. 154(b) by 0 days.

(21) Appl. No.: 11/520,113

(22) Filed: Sep. 13, 2006

(65) Prior Publication Data

US 2007/0074842 A1 Apr. 5, 2007

Related U.S. Application Data

(60) Provisional application No. 60/716,678, filed on Sep. 13, 2005, provisional application No. 60/790,203, filed on Apr. 7, 2006.

(51) Int. Cl.
*B22D 17/08* (2006.01)
*B22D 17/10* (2006.01)

(52) U.S. Cl. ..... 164/113; 164/312

(58) Field of Classification Search ..... 164/113, 164/312

See application file for complete search history.

(56) References Cited

U.S. PATENT DOCUMENTS

| | | | | |
|---|---|---|---|---|
| 3,515,203 A | | 6/1970 | Parlanti | |
| 3,516,480 A | * | 6/1970 | Woltering | 164/312 |
| 3,664,411 A | * | 5/1972 | Carver et al. | 164/312 |
| 3,685,572 A | * | 8/1972 | Carver et al. | 164/312 |
| 4,036,113 A | | 7/1977 | Kunz | |
| 4,086,953 A | | 5/1978 | Kraklau | |
| 4,154,288 A | | 5/1979 | Borgen | |
| 4,311,185 A | | 1/1982 | Zimmerman | |
| 4,334,575 A | | 6/1982 | Miki | |
| 4,463,793 A | | 8/1984 | Thurner | |
| 4,534,403 A | | 8/1985 | Harvill | |
| 4,583,579 A | | 4/1986 | Miki | |
| 4,598,762 A | | 7/1986 | Glas | |
| 4,623,015 A | | 11/1986 | Zecman | |
| 4,664,173 A | | 5/1987 | Wolniak | |
| 4,667,729 A | | 5/1987 | Zecman | |
| 4,842,039 A | | 6/1989 | Kelm | |
| 4,886,107 A | | 12/1989 | Zecman | |
| 4,899,804 A | | 2/1990 | Hammerer | |
| 5,048,592 A | | 9/1991 | Mueller | |
| 5,076,343 A | | 12/1991 | Sandercock | |
| 5,076,344 A | | 12/1991 | Fields | |
| 5,425,411 A | | 6/1995 | Kami | |
| 6,378,597 B1 | | 4/2002 | Zecman | |

(Continued)

*Primary Examiner*—Kuang Lin
(74) *Attorney, Agent, or Firm*—Polster Lieder Woodruff & Lucchesi, L.C.

(57) ABSTRACT

An insert for a die casting assembly. The insert comprises a cast iron insert having a first end, a second end and a body disposed between the first end and the second end, the body having a pour aperture in communication with a pour hole of a shot sleeve. The insert is removeably positioned within a groove of the shot sleeve wherein the molten material that is dispensed from the pour hole and into the pour aperture initially contacts the cast iron insert when the molten material flows into the cast iron insert such that the cast iron insert withstands heat erosion effects applied by the molten material to provide a smooth path for the plunger as the plunger reciprocates within a sleeve bore of the shot sleeve and pushes the molten material into a mold cavity.

7 Claims, 2 Drawing Sheets

U.S. PATENT DOCUMENTS

| | | | |
|---|---|---|---|
| 6,425,434 | B1 | 7/2002 | Muller |
| 6,598,450 | B2 | 7/2003 | Blue |
| 6,820,679 | B1 | 11/2004 | Lutze |
| 2004/0026060 | A1 | 2/2004 | Scott |
| 2004/0084816 | A1 | 5/2004 | Hildreth |
| 2005/0056394 | A1 | 3/2005 | Kamm |

* cited by examiner

FIG. 1
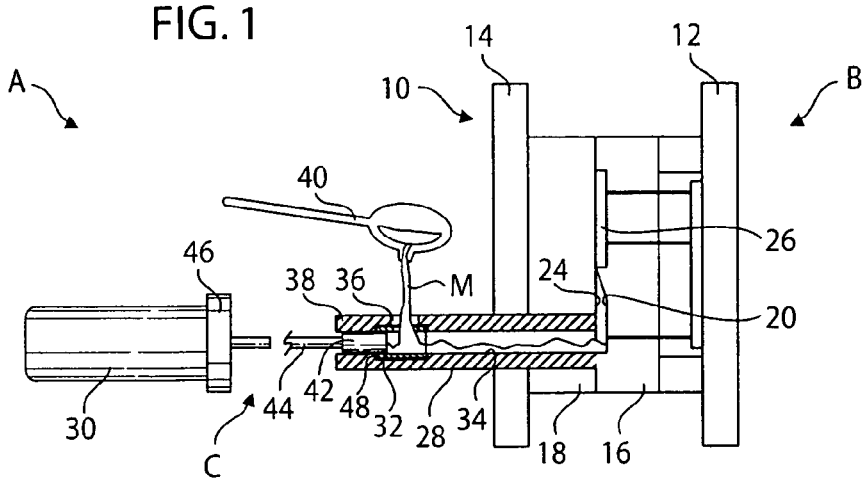
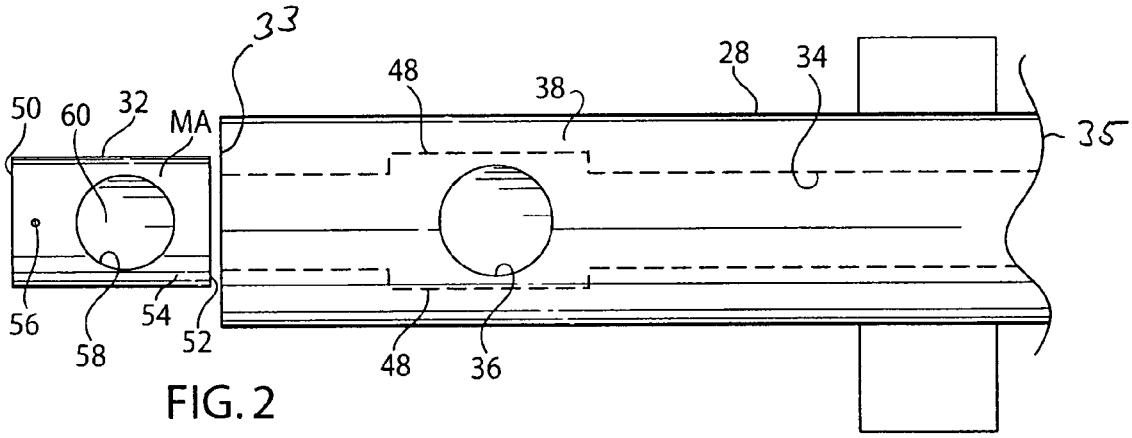
FIG. 2
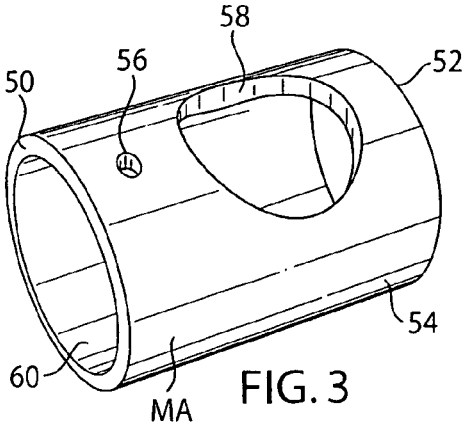
FIG. 3
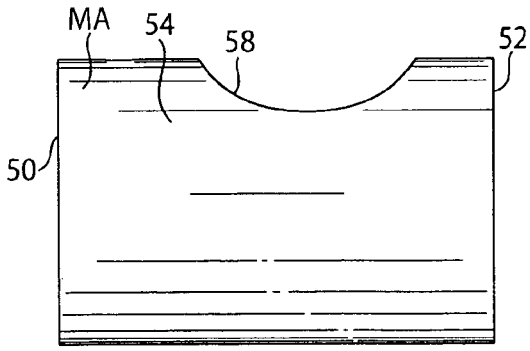
FIG. 4

SHOT SLEEVE INSERT AND METHOD OF RETARDING HEAT EROSION WITHIN A SHOT SLEEVE BORE

CROSS-REFERENCE TO RELATED APPLICATIONS

This application claims priority under 35 U.S.C. § 119(e) of U.S. Provisional Patent Application No. 60/716,678 filed Sep. 13, 2005, in the name of the present inventor and claims priority under 35 U.S.C. § 119(e) of U.S. Provisional Patent Application No. 60/790,203 filed Apr. 7, 2006, in the name of the present inventor.

STATEMENT REGARDING FEDERALLY SPONSORED RESEARCH

Not Applicable.

BACKGROUND OF THE DISCLOSURE

This disclosure relates to an insert for a die casting apparatus, and in particular, to an insert that retards erosion of a shot sleeve bore used in the die casting apparatus.

Die-casting is a common used technology for manufacturing material articles. Typically, the die casting apparatus includes a pair of die halves each formed with a void corresponding to a portion of the article to be cast. When the two die halves are brought together in proper alignment, their respective voids cooperate to form a die cavity corresponding to the shape of the article to be cast. Molten material is introduced into the die cavity and allowed to cure—typically by cooling the molten material to allow it to solidify. Once the material is sufficiently cured, the die halves are opened and the cast article is removed.

The die cast apparatus includes a shot sleeve to inject the molten material into the die cavity. This shot sleeve defines an internal sleeve bore communicating with the die cavity. The shot sleeve further includes a pour hole that accepts the molten material and directs the molten material to the sleeve bore. A plunger reciprocates within the sleeve bore to inject or force the molten material into the die cavity, wherein a hydraulic cylinder reciprocates the plunger via a plunger rod. Extension of the plunger injects the molten material within the shot sleeve into the die cavity. Retraction of the plunger withdraws the plunger to permit filling the shot sleeve for the next shot of molten material.

When the molten material flows through the pour hole and into the sleeve bore, the molten material erodes the material of the sleeve bore opposite the pour hole due to the temperature of molten material and due to the material composition of the sleeve bore. This heat erosion is a major cause of shot sleeve failure. Current methods to minimize erosion include using heavy walls for the shot sleeve, nitiriding the shot sleeve, lowering material temperatures and using water-cooling. These methods do not provide sufficient erosion protection. Additionally, these methods require costly equipment to minimize erosion. Furthermore, these methods require substantial production and maintenance costs for the shot sleeve.

BRIEF DESCRIPTION OF THE SEVERAL VIEWS OF THE DRAWINGS

In the accompanying drawings which form part of the specification:

FIG. 1 is a side elevational view partly in cross section of a die casting apparatus illustrating a shot sleeve, a sleeve bore and a sleeve insert constructed in accordance with and embodying the present disclosure;

FIG. 2 is an expanded top view partly in detail of the sleeve bore and sleeve insert of FIG. 1;

FIG. 3 is a perspective view of the sleeve insert of FIGS. 1 and 2;

FIG. 4 is a side elevational view of the sleeve insert of FIG. 3; and

Corresponding reference characters indicate corresponding parts throughout the several views of the drawings.

SUMMARY OF THE DISCLOSURE

Figure 5A:
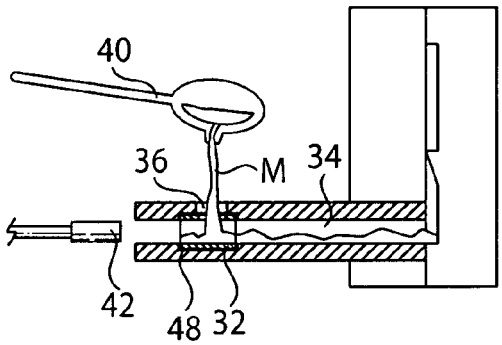
FIGS. 5*a*-5*d* are schematic side elevational views partly in section of the die casting apparatus performing a die casting cycle while using the sleeve insert of the present disclosure.

The disclosure relates to an insert for a die casting apparatus. The die casting apparatus die casting assembly moves molten material dispensed from a pour hole and into a mold cavity. The apparatus comprises a shot sleeve having a sleeve bore extending therethrough from a first sleeve end to a second sleeve end. The sleeve bore further has a groove positioned between the first sleeve end and the second sleeve end and positioned around the pour hole.

The insert comprises a cast iron insert having a first end, a second end and a body disposed between the first end and the second end, the body having a pour aperture in communication with a pour hole of a shot sleeve. The insert is removeably positioned within a groove of the shot sleeve wherein the molten material that is dispensed from the pour hole and into the pour aperture initially contacts the cast iron insert when the molten material flows into the cast iron insert such that the cast iron insert withstands heat erosion effects applied by the molten material to provide a smooth path for the plunger as the plunger reciprocates within a sleeve bore of the shot sleeve and pushes the molten material into a mold cavity.

DESCRIPTION OF THE PREFERRED EMBODIMENT

The following detailed description illustrates the disclosure by way of example and not by way of limitation. The description clearly enables one skilled in the art to make and use the disclosure, describes several embodiments, adaptations, variations, alternatives, and uses of the disclosure, including what is presently believed to be the best mode of carrying out the disclosure.

Referring to the drawings, a die casting assembly A generally shown includes a die assembly B defining the shape of an article to be cast and a material delivery assembly generally shown as C for forcing molten material M into the die assembly B to create cast objects (FIG. 1). While the present disclosure is described in connection with a horizontal casting system, the present disclosure is equally well suited for use with vertical casting systems. The terms outer and inner are used herein as expedients to describe the directions away from and toward the die assembly B respectively. Similarly, the terms retraction and extension are used as expedients to describe movement away from and toward the die assembly B, respectively.

Turning to FIG. 1, the die assembly B includes a die 10, a movable platen 12, and a stationary platen 14. The die 10 includes an ejector die 16 mounted to the movable platen 12 and a cover die 18 mounted to the stationary platen 14. An inner surface 20 of the ejector die 16 is contoured to match a portion of the profile of an article 22 (FIG. 5*c*) to be cast.

Similarly, an inner surface 24 of the cover die 18 is contoured to match the remaining portion of the profile of the article 22 to be cast.

When the ejector die 16 and cover die 18 are brought together, the contoured inner surfaces 20, 24 cooperate to form a void or die cavity 26, which defines the shape of the article 22 to be cast. Preferably, the movable platen 12 is mounted to conventional hydraulic means (not shown) to provide the movable platen 12 and ejector die 16 with appropriate movement. In more complex casting systems, more than two dies 10 may define the profile of the article 22 to be cast.

Still referring to FIG. 1, material delivery assembly C generally includes an elongated shot sleeve 28, a shot cylinder 30 and an insert 32. The shot sleeve 28 is mounted partially within the stationary platen 14 and within the cover die 18. The shot sleeve 28 is generally cylindrical and includes a concentric internal sleeve bore 34 and a pour hole 36. The sleeve bore 34 extends from a first sleeve end 33 to a second sleeve end 35, wherein the second sleeve end 35 is positioned proximate the mold cavity 26. The sleeve bore 34 is in communication with the short cylinder 30 near the first sleeve end and is in fluid communication with the die cavity 26 near the second sleeve end 35. The pour hole 36 is provided in an upper circumferential region 38 of the shot sleeve 28 for communication with the sleeve bore 34. It will be understood that the pour hole 36 allows molten material M to be poured from a pouring implement 40 such as a ladle into the sleeve bore 34 of the shot sleeve 28. In one embodiment, the sleeve bore 34 comprises a ferrous material such as but not limited to material designated in the industry as "H13".

As shown in FIG. 1, a plunger 42 is slidably positioned in the sleeve bore 34. The plunger 42 seals off the outer end of the shot sleeve 28 and reciprocates within sleeve bore 34 to inject molten material M into the die cavity 26. The plunger 42 is connected to the shot cylinder 30 by a plunger rod 44. The shot cylinder 30 is a generally conventional hydraulic cylinder, wherein the shot cylinder rod (not shown) connects to plunger rod 44 by an adapter (not shown). The shot cylinder 30 may include a cylindrical barrel having a cylindrical internal bore, and a barrel cap 46 for capping and sealing off the outer end of the shot cylinder 30.

For maximum productivity and life cycles for the shot sleeve 28 and the plunger 42, the plunger 42 must consistently move smoothly through a nearly perfectly round, straight sleeve bore 34. As such, the shot sleeve 28 requires minimum erosion of the internal sleeve bore 34 in the area opposite of the pour hole 36. As previously noted, this area of the sleeve bore 34 experiences enhanced corrosion since this area initially receives the impact of the hot molten material.

Referring to FIG. 2, the sleeve bore 34 of the shot sleeve 28 includes a groove 48. The groove 48 extends within the sleeve bore 34 in the circumferential region 38 of the pour hole 36. As shown, the groove 48 is positioned between the first sleeve end 33 and the second sleeve end 35. As such, the groove 48 extends within the circumferential region 38 of the sleeve bore 34 to surround the pour hole 36. In one embodiment, the groove 48 extends within the sleeve bore 34 about a ⅛-inch.

Turning to FIGS. 3 and 4 and referring to FIG. 2, the insert 32 comprises a first end 50, a second end 52 and a body 54 disposed between the first end 50 and the second end 52. The body 54 is continuous and free from any channels or voids. The body 54 defines a fastener receptacle 56 such as a threaded portion that accepts a fastener such as a screw. The insert 32 further comprises a pour aperture 58 defined therethrough, wherein the pour aperture 58 matches the configuration of the pour hole 36. The pour aperture 58, however, has a larger inner diameter than the inner diameter of the pour hole 56.

In an embodiment, the insert 32 comprises a cast iron material MA throughout the first end 50, second end 52 and the body 54. In one embodiment, only a lower circumferential region 60 of the first end 50, second end 52 and body 54 comprises the cast iron material MA. The cast iron material MA of the insert 32 withstands heat effects applied by the molten material M as the molten material M flows through the pour hole 36 and against the insert 32. As such, the insert 32 retards erosion opposite the pour hole 36. In one embodiment, the cast iron material MA of the insert 32 comprises Schedule 40 cast iron.

The present disclosure comprises a bi-metal system with respect to the shot sleeve 28 and the insert 32. As noted, the shot sleeve 28 comprises a ferrous material such as "H13" metal and the insert 32 comprises cast iron material such as Schedule 40 cast iron. This bi-metal configuration assists in thermal compensation when the material delivery assembly C directs the molten material M. This material difference further withstands heat affects of the molten material M to retard corrosion opposite the pour hole 36.

During operation (FIG. 5*a*-5*d*), the operator inserts the insert 32 within the groove 48. Since the insert 32 is adapted to match the configuration of the groove 48, the inner surface of the insert 32 is positioned flush with the inner surface of the sleeve bore 34. The insert 32 is removably insertable within the groove 48 to allow interchangeability of the insert 32 to accommodate different configurations and thicknesses of the insert 32. A fastener (not shown) such as a screw may then connect the insert 32 to the shot sleeve 28 via an aperture through the shot sleeve 28 and the fastener receptacle 56. In other words, the screw inserts through the aperture of the shot sleeve 28 and fastens into the fastener receptacle 56 to connect together the shot sleeve 28 and the insert 32. After positioning the insert 32 within the sleeve bore 34, the plunger 42 is retracted to expose the pour hole 36 to the insert 32 (via the pour aperture 58).

Figure 5B:
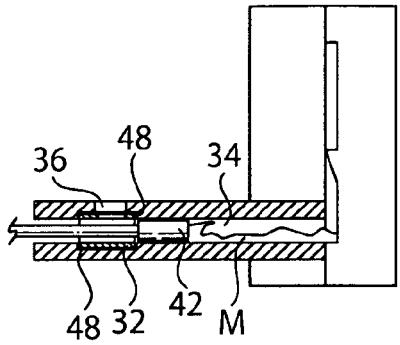
Figure 5C:
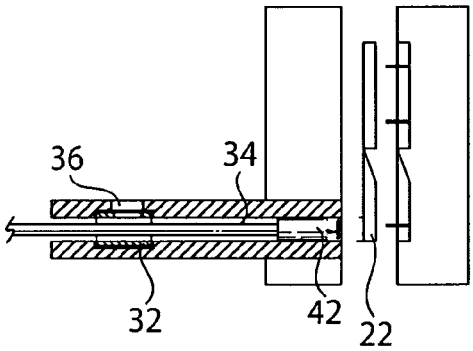
Figure 5D:
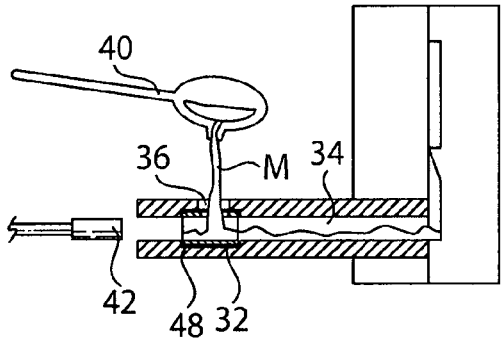

The ladle 40 pours an appropriate amount of hot molten material M such as aluminum into the sleeve bore 34 (FIG. 5*a*). The hot molten material M initially contacts the insert 32 in the lower circumferential region 60 opposite the pour hole 36. The plunger 42 then extends within the insert 32 and sleeve bore 34 to move the molten material M through the sleeve bore 34 (FIG. 5*b*). The plunger 42 discharges the molten material M into the die cavity 26 of the associated die 10. The plunger 42 maintains the molten material M under high pressures during solidification of the molten material M. After complete solidification, the plunger 42 retracts, the die 10 opens and the cast article 22 is ejected (FIG. 5*c*). The die casting apparatus A is reset (FIG. 5*d*) for another shot process.

Since the insert 32 comprises a cast iron material, the insert 32 may accept the hot molten material M without any or limited heat erosion effects applied to the circumferential region 38 of the sleeve bore 34 opposite the pour hole 36. The shot sleeve 28 comprising the ferrous material further assists in limiting heat erosion effects applied to the sleeve bore 34 as the molten material M travels through the sleeve bore 34 beyond the insert 32.

In view of the above, it will be seen that the several objects of the disclosure are achieved and other advantageous results are obtained. As various changes could be made in the above constructions without departing from the scope of the disclosure, it is intended that all matter contained in the above description or shown in the accompanying drawings shall be interpreted as illustrative and not in a limiting sense.

The invention claimed is:

1. A die casting assembly for moving molten aluminum dispensed from a pour hole and into a mold cavity, comprising:

a shot sleeve, the shot sleeve having a sleeve bore continuously extending therethrough from a first sleeve end to a second sleeve end which is positioned proximate the mold cavity, the shot sleeve further having a groove radially positioned between the first sleeve end and the second sleeve end and positioned around the pour hole;

a cap connected to the shot sleeve, the cap being configured to cover and seal the first sleeve end;

a plunger slidably positioned in the sleeve bore and through the cap; and a Schedule 40 cast iron insert having a first end, a second end and a body disposed between the first end and the second end, the body having a pour aperture, the Schedule 40 cast insert being sized and shaped to removeably position within the groove to communicate with the pour aperture with the pour hole whereby the molten aluminum that is dispensed from the pour hole and into the pour aperture initially contacts the Schedule 40 cast iron insert when the aluminum flows onto the Schedule 40 cast iron insert such that the Schedule 40 cast iron insert withstands heat erosion effects applied by the molten aluminum to provide a smooth path for the plunger as the plunger reciprocates within the sleeve bore and pushes the molten aluminum into the mold cavity.

2. The assembly of claim 1 wherein the shot sleeve comprises a ferrous material.

3. The assembly of claim 1 wherein the groove includes a depth of ⅛ inch into the shot sleeve.

4. In a die casting assembly having a die assembly and a material delivery assembly, the die assembly comprising a shot sleeve assembly for moving molten aluminum dispensed from a pour hole and into a mold cavity, the shot sleeve assembly includes a shot sleeve, the shot sleeve having a sleeve bore extending therethrough, the sleeve bore further having a groove positioned around the pour hole, the material delivery assembly comprising a cap connected to the shot sleeve which is configured to seal the shot sleeve and comprising a plunger slidably positioned in the sleeve bore, the improvement comprising:

a Schedule 40 cast iron insert having a first end, a second end and a body disposed between the first end and the second end, the body having a pour aperture, the Schedule 40 cast insert being sized and shaped to removeably position within the groove to communicate the pour aperture with the pour hole whereby the molten aluminum that is dispensed from the pour hole and into the pour aperture initially contacts the Schedule 40 cast iron insert when the aluminum flows onto the Schedule 40 cast iron insert such that the Schedule 40 cast iron insert withstands heat erosion effects applied by the molten aluminum to provide a smooth path for the plunger as the plunger reciprocates within the sleeve bore and pushes the molten aluminum into the mold cavity.

5. A method of retarding heat erosion effects within a sleeve bore of a shot sleeve assembly, comprising:

removeably positioning a Schedule 40 cast iron insert within a groove of the sleeve bore;

discharging molten aluminum against the Schedule 40 cast insert and within the sleeve bore; and moving the molten aluminum through the Schedule 40 cast iron insert and sleeve bore and into a mold cavity by a plunger wherein the molten aluminum initially contacts the Schedule 40 cast iron insert when the molten aluminum discharges from the pour hole such that the cast iron insert withstands heat erosion effects applied by the molten aluminum to provide a smooth path for the plunger as the plunger reciprocates within the sleeve bore and Schedule 40 cast iron insert.

6. The method of claim 5 wherein the shot sleeve comprises a different material than the Schedule 40 cast iron insert.

7. The method of claim 6 and wherein the shot sleeve comprises a ferrous material.

* * * * *

UNITED STATES PATENT AND TRADEMARK OFFICE

CERTIFICATE OF CORRECTION

PATENT NO. : 7,464,744 B2
APPLICATION NO. : 11/520113
DATED : December 16, 2008
INVENTOR(S) : Peter Manoff It is certified that error appears in the above-identified patent and that said Letters Patent is hereby corrected as shown below:

In Column 4, lines 13 - 14, “Schedule 40” should read --Class 40--;

In Column 4, line 19, “Schedule 40” should read --Class 40--;

In Claim 1, lines 15, 17 -18, 22, 23, 24, for “Schedule 40”, each occurrence should read --Class 40--;

In Claim 4, lines 5, 7 - 8, 12, 13, 14 for “Schedule 40”, each occurrence should read --Class 40--;

In Claim 5, lines 21, 23, 25, 28, 33 for “Schedule 40”, each occurrence should read --Class 40--;

In Claim 6, line 35, “Schedule 40” should read --Class 40--.

Signed and Sealed this

Fourteenth Day of July, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,464,744 B2
APPLICATION NO. : 11/520113
DATED : December 16, 2008
INVENTOR(S) : Peter Manoff It is certified that error appears in the above-identified patent and that said Letters Patent is hereby corrected as shown below:

In Column 4, lines 13 - 14, "Schedule 40" should read --Class 40--;

In Column 4, line 19, "Schedule 40" should read --Class 40--;

In Column 5, Claim 1, lines 15, 17 - 18, 22, 23, 24, for "Schedule 40", each occurrence should read --Class 40--;

In Column 6, Claim 4, lines 5, 7 - 8, 12, 13, 14 for "Schedule 40", each occurrence should read --Class 40--;

In Column 6, Claim 5, lines 21, 23, 25, 28, 33 for "Schedule 40", each occurrence should read --Class 40--;

In Column 6, Claim 6, line 35, "Schedule 40" should read --Class 40--.

This certificate supersedes the Certificate of Correction issued July 14, 2009.

Signed and Sealed this

Eighteenth Day of August, 2009

David J. Kappos

David J. Kappos
*Director of the United States Patent and Trademark Office*